US008893412B2

(12) United States Patent
Pendleton

(10) Patent No.: US 8,893,412 B2
(45) Date of Patent: Nov. 25, 2014

(54) DOCUMENTING GROWTH PROGRESSION

(76) Inventor: Nathan S Pendleton, Tampa, FL (US)

( * ) Notice: Subject to any disclaimer, the term of this patent is extended or adjusted under 35 U.S.C. 154(b) by 1170 days.

(21) Appl. No.: 12/829,124

(22) Filed: Jul. 1, 2010

(65) Prior Publication Data

US 2012/0000099 A1 Jan. 5, 2012

(51) Int. Cl.

| | |
|---|---|
| ***G09D 3/00*** | (2006.01) |
| ***G09F 23/14*** | (2006.01) |
| ***A63H 3/02*** | (2006.01) |
| ***G09F 7/02*** | (2006.01) |
| ***A63H 3/00*** | (2006.01) |

(52) U.S. Cl.
CPC *G09F 23/14* (2013.01); *A63H 3/02* (2013.01); *G09F 7/02* (2013.01); *A63H 3/003* (2013.01)
USPC ..... 40/107; 40/725; 40/1.6; 446/369

(58) Field of Classification Search
USPC ..... 40/107, 725, 1.5, 1.6; 446/369
See application file for complete search history.

(56) References Cited

U.S. PATENT DOCUMENTS

| | | | | |
|---|---|---|---|---|
| 1,463,739 | A * | 7/1923 | Draper | 40/1.6 |
| 4,937,962 | A * | 7/1990 | Hornblad | 40/617 |
| 5,059,149 | A | 10/1991 | Stone | |
| 5,369,899 | A * | 12/1994 | Reeves | 40/1.5 |
| 5,640,859 | A * | 6/1997 | Fromm | 68/213 |
| 5,807,155 | A | 9/1998 | Divvleeon | |
| 6,069,848 | A | 5/2000 | McDonald et al. | |
| 6,146,722 | A * | 11/2000 | Slawin | 428/13 |
| 6,188,311 | B1 | 2/2001 | Rothschild | |
| D475,300 | S | 6/2003 | Dunn | |
| 6,699,100 | B1 | 3/2004 | Burns | |
| 7,020,047 | B1 | 3/2006 | Brock | |
| 2003/0150149 | A1 * | 8/2003 | Quick | 40/725 |
| 2005/0079791 | A1 * | 4/2005 | Treibitz et al. | 446/391 |
| 2006/0272191 | A1 * | 12/2006 | Han | 40/771 |

OTHER PUBLICATIONS

"Making it Lovely," http://makingitlovely.com/2009/05/29/one-month-old/, May 29, 2009.*
"Russell Ranch," http://russellranch.net/?p=212, Feb. 21, 2010.*
Dingmann, A., "Simple Ways to Record Your Baby's First Year" [online], [retrieved on Aug. 19, 2014]. Retrieved from the Internet: http://www.essortment.com/simple-ways-record-babys-first-year-56401.html, 10 pages.

* cited by examiner

*Primary Examiner* — Gary Hoge
(74) *Attorney, Agent, or Firm* — Fish & Richardson P.C.

(57) ABSTRACT

A system for documenting the growth progression of an infant including an indicator that identifies a date associated with the infant or an age of the infant, and an object, unchangeable in size, comprising an element for removably attaching the indicator to the object.

19 Claims, 3 Drawing Sheets

DOCUMENTING GROWTH PROGRESSION

TECHNICAL FIELD

This disclosure is generally related to monitoring and/or documenting growth progression.

BACKGROUND

Monitoring and documenting the developmental milestones of a growing child can include regularly snapping photographs as the child progresses, measuring the child against a growth chart, and weighing the child. Often, the statistics are collected in a baby album, while the photographs are collected in a photo album.

Some digital cameras include an automatic timestamp attached to the image file or printed on the lace of the image. The timestamp can be used to track the age of the child in each photograph. Alternatively, or additionally, the age can be tracked and later written next to the photograph when placed in a photo album.

Over a period of time, multiple photographs of the child can be taken on a particular blanket or next to a favorite toy. The constant size of the chosen item can serve as a visual comparison to maintain a record of the child's relative growth.

Some toys include the ability to display changeable information. In some examples, personalized pictures or messages can be drawn or otherwise presented on toys such as washable fabric paint drawing cloths, erasable chalk boards or magnetic scribble boards, or simple digital computing devices with keypad or stylus interfaces.

SUMMARY

In a general aspect, a system for documenting the growth progression of an infant includes an indicator that identities a date associated with the infant or an age of the infant, and an object, unchangeable in size, including an element for removably attaching the indicator to the object.

Implementations may include one or more of the following features. For example, the object is a three-dimensional toy. The object is a plush toy and the element is included on an item of apparel associated with the plush toy. The element includes one of a hook and loop fastener, a magnet, a zipper section, a snap section, a hook and eye portion, a button, a buttonhole, or a tie, and the indicator includes respective connection points for removable attachment to the element. The element includes one of a set of rails or a transparent pocket. The object further includes a second element for removably attaching a second indicator that identifies a weight or height of the infant. The indicator includes a set of numerals corresponding to the age described in relation to one of days, weeks, months, or years. The set of numerals further correspond to the age described in relation to months, and wherein the object further includes a second element for removably attaching numerals corresponding to the age in months. The system further includes at least two messages with respective connection points for removable attachment to the object, wherein a first message corresponds to the age described in relation to weeks and a second message corresponds to the age described in relation to months, and wherein the object further includes a fourth element and a fifth element for removably attaching the at least two messages. The system further includes a photograph display object including a decoration similar in appearance to the object.

In another aspect, an apparatus for documenting the growth progression of an object capable of growth includes an indicator that identifies a date associated with the object, or an age of the object, and an article, unchangeable in size, comprising an element for removably attaching the indicator to the article.

Implementations may include one or more of the following features. For example, the element includes one of a hook and loop fastener, a magnet, a zipper section, a snap section, a hook and eye portion, a button, a buttonhole, or a tie, and the indicator includes respective connection points for removable attachment to the element. The article is a three-dimensional plush toy and the element is included on an item of apparel associated with the plush toy. The element includes one of a set of rails or a transparent pocket.

In another aspect, a method for documenting the growth progression of an object capable of growth includes providing an indicator that identifies a date associated with the object, or an age of the object, and providing an article, unchangeable in size, including an element for removably attaching the indicator to the article.

Implementations may include one or more of the following features. For example, the method further includes taking a photograph of the object, the indicator, and the article at a first time, and taking a photograph of the object, the indicator, and the article at a second time, wherein the indicator indicates a different date associated with the object or a different age of the object at the second time as compared to the first time.

DETAILED DESCRIPTION

Documenting growth, be it of an infant, a pet, or a prized orchid, can include collecting periodic photographs. Rather than depending upon a timestamp stored in the camera, or remembering to log the date on which each photo was taken, the photo can be taken next to an object, unchangeable in size, marked with, for example, a date or an age. The date or age information can be attached to the object using individual indicators, such as numerals, or connected to attachment points on the object. In this manner, the date or age can be updated at the next photo session. Because the object is unchangeable in size, each photo additionally provides a visual comparison of growth relative to the object.

Figure 1A:
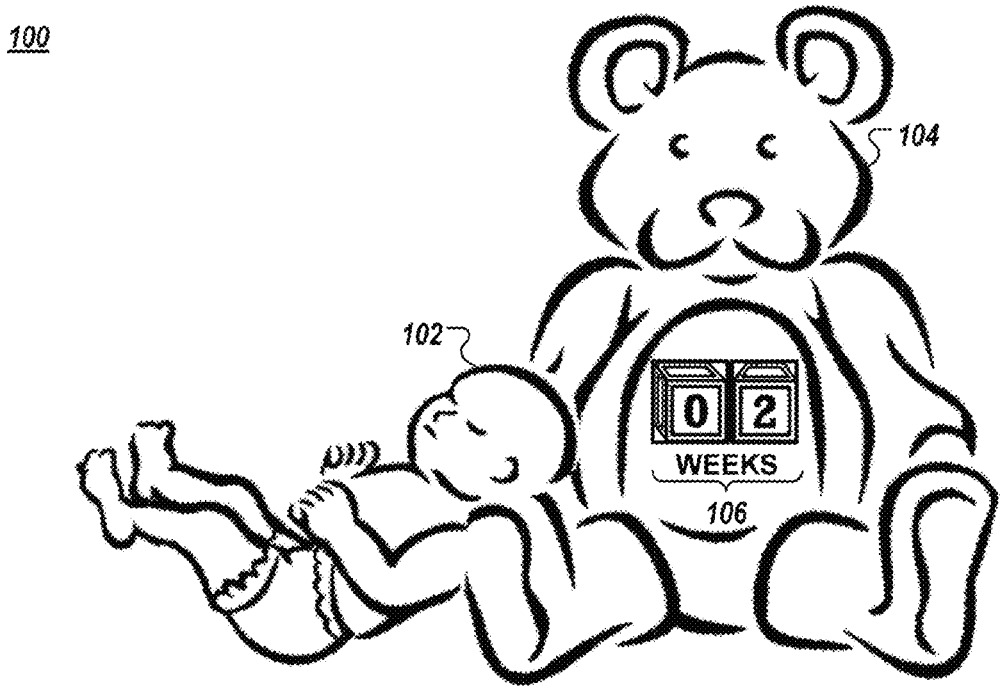
FIGS. 1A and 1B are diagrams illustrating photographs taken using a method for documenting growth progression.
Figure 1B:
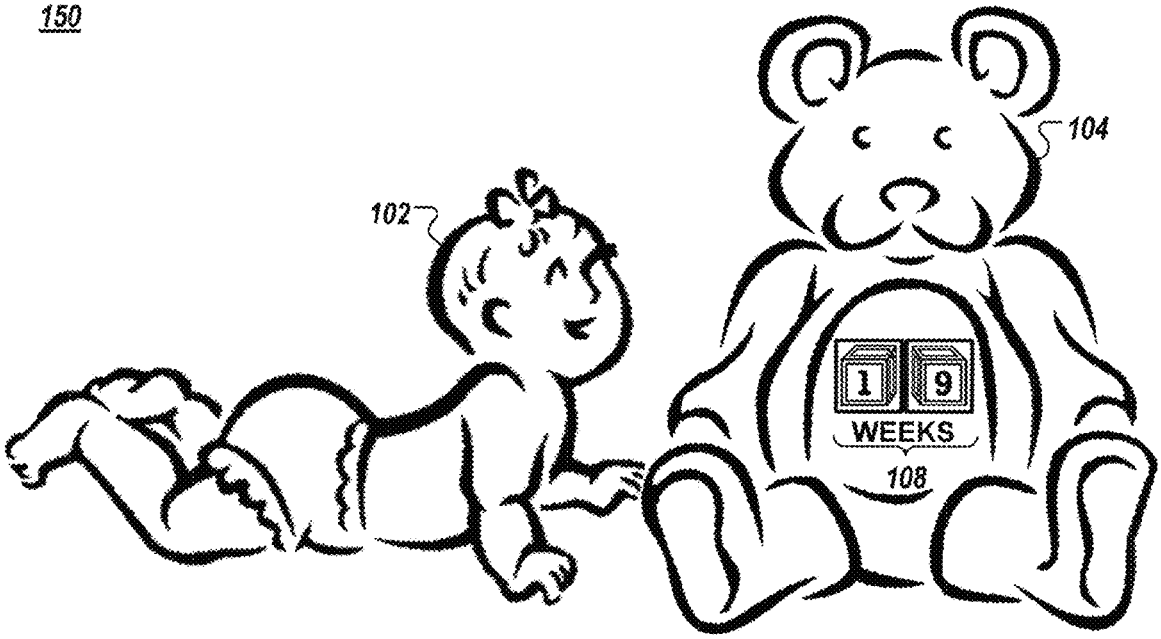

FIGS. 1A and 1B are diagrams illustrating images or photographs 100 and 150 taken using a plush bear 104 for documenting growth progression. Each photograph 100, 150 contains an infant 102 next to the plush bear 104. The plush hear 104 is marked with numerals indicating the age of the infant 102 in weeks.

As shown in FIG. 1A, the first photograph 100 presents the infant 102 at age two weeks, as indicated by a first set of digits 106 "02" attached to the stomach of the plush bear 104. The first set of digits 106, in some examples, can be connected to the plush bear 104 using a hook and loop fastener such as Velcro® fasteners, a magnet, a zipper, a snap, a hook and eye, a button, or a tie. The first set of digits 106, for example, can be a portion of a full collection of indicators, provided with the plush bear 104, for marking the incremental age during growth. In some implementations, the first set of digits 106 and the connecting method used on the plush bear 104 allows the plush bear 104 to be child safe as a play toy for the infant 102.

Below the first set of digits 106, the term "WEEKS" is presented on the stomach of the plush bear 104. In some implementations, the term "WEEKS" is interchangeable in a similar manner to the first set of digits 106. For example, the terms "DAYS", "WEEKS", "MONTHS", and "YEARS" (and, optionally, singular versions of each) can be provided with the bear along with a collection of numerals so that, as growth progresses, the age can be incrementally updated. Alternatively, the term "WEEKS" can be stitched or printed to the plush bear 104.

The second photograph 150 presents the infant 102 at age nineteen weeks, as indicated by a second set of digits 108 "19" attached to the plush bear 104. The infant 102 is visibly larger in comparison to the plush bear 104 than in the first photograph 100. In addition to the first photograph 100 and the second photograph 150, photographs of the infant 102 next to the plus bear 104 may have been taken incrementally each week (e.g., from age three weeks to age eighteen'weeks). The collection of photographs can be displayed to illustrate the growth progression of the infant 102, week by week, as judged in comparison to the size of the plush bear 104 and as noted by the age indicated upon, for example, the stomach of the plush bear 104 each week.

Although the photographs 100 and 150 picture an infant beside a plush bear, in some implementations, various objects of unchanging size can be photographed beside an object capable of growth. In some examples, a plant, an animal, or a crystal garden can be positioned adjacent to an object of unchanging size such as a toy, figurine, or small furnishing (e.g., lamp, clock, etc.) including one or more connection elements used to removably attach one or more age indicators. In some implementations, rather than using interchangeable numerals on the object, the numerals can be programmed into a digital display attached to or integral with the object.

Figure 2A:
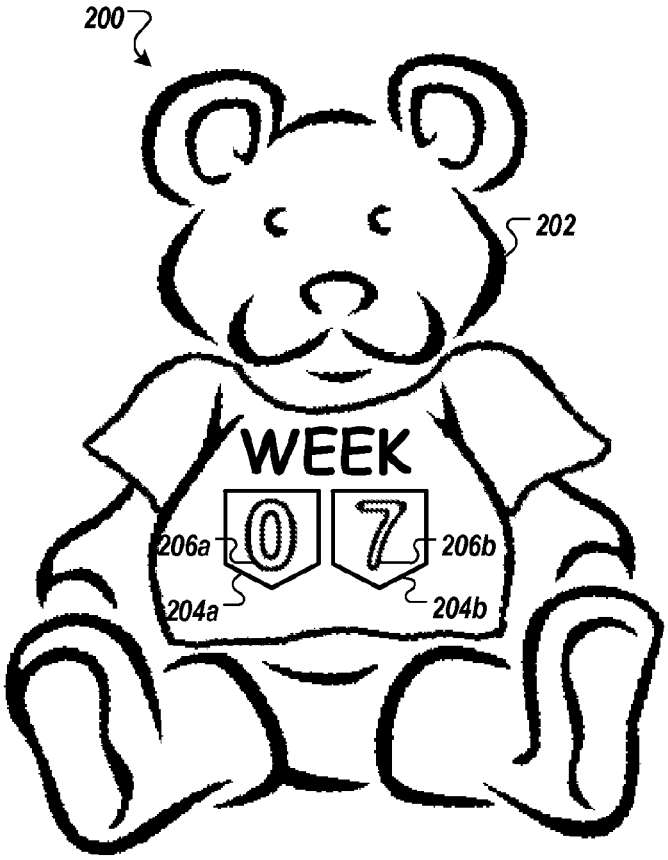
FIGS. 2A-2C illustrate example apparatus for documenting growth progression.
Figure 2C:
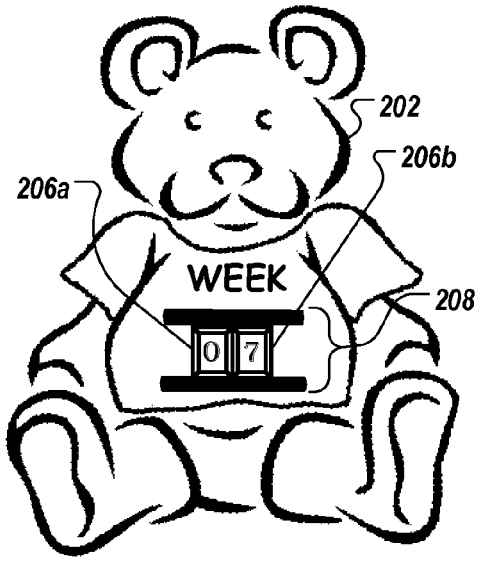
Figure 2B:
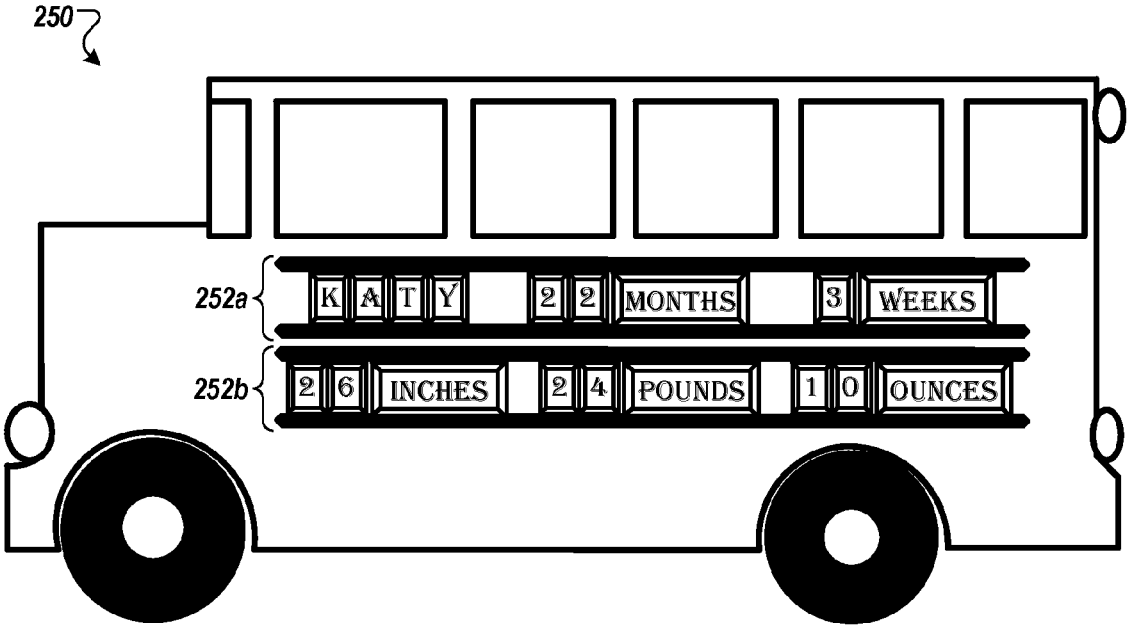

FIGS. 2A-2C illustrate example apparatus for documenting growth progression. The apparatus, for example, can be marked with removably attachable indicators providing a date or an age. The apparatus can then be placed near an infant or other object capable of growth and photographed.

As shown in FIG. 2A, a plush bear 200 is dressed in a shirt 202 with a set of pockets 204. The shirt 202 has been marked above the pockets 204 with the word "WEEK". A digit 206*a*, 206*b* has been placed in each of the respective pockets 204*a* and 204*b*, indicating, for example, the age of an object capable of growth in terms of weeks. As shown in FIG. 2C, the plush bear 200 may include one or more sets of rails 208 configured to support one or more digits 206*a*, 206*b*, indicating, for example, the age of an object capable of growth in terms of weeks.

The pockets, for example, can be made of clear or semi-transparent material such as plastic, nylon, thin silk, organza, netting, or tiffany. The digits can be made of a rigid, semi-rigid, or flexible material such as, in some examples, plastic, wood, metal, fabric, or a combination thereof. In some implementations, the digits can each be provided to an infant as an individual toy. For example, the digits 206*a* and 206*b* can be included in a set of digits of various textures, fabrics, colors, or materials each to respectively be used as an infant toy.

Although the shirt 202 is marked with the word "WEEK", in other implementations, the digits 206 can be used to indicate a different set timeframe, such as days, months, or years. Rather than being printed with the word "WEEK", for example, the shirt 202 could include an attachment point for a removably attachable set of terms, such as "DAY", "MONTH", or "YEAR".

In some implementations, rather than the shirt 202, another item of apparel can include attachment features for removably attaching one or more indicators. For example, a hat, jacket, or outfit (e.g., pajamas, onesie, or jumpsuit) can include transparent or semi-transparent pockets, hook and loop fasteners, buttons, snaps, or other elements for attaching indicators.

In another example, as shown in FIG. 2B, a school bus 250 (e.g., three dimensional toy, two dimensional figurine or photo frame on a stand) includes two sets of rails 252 configured to support one or more tiles used to indicate information regarding an object capable of growth. The information, in some examples, can include age, height, or weight. An object capable of growth can be placed near the school bus 250 and photographed to document growth progression of the object. In some examples, the tiles can slide between each set of rails 252, or the rails 252 can be used as guides for placement of magnetic indicators.

As illustrated, a first set of rails 252*a* includes tiles indicating the message "KATY 22 MONTHS 3 WEEKS", and a second set of rails 252*b* includes tiles indicating the message "26 INCHES 24 POUNDS 10 OUNCES". Tiles can be provided with the school bus 250 including individual letters, as illustrated in the name "KATY" or specific words, as illustrated in the terms "MONTHS", "WEEKS", "INCHES", "POUNDS", and "OUNCES". Individual numerals can similarly be provided with the school bus 250 to represent current age, height, or weight.

Figure 3:
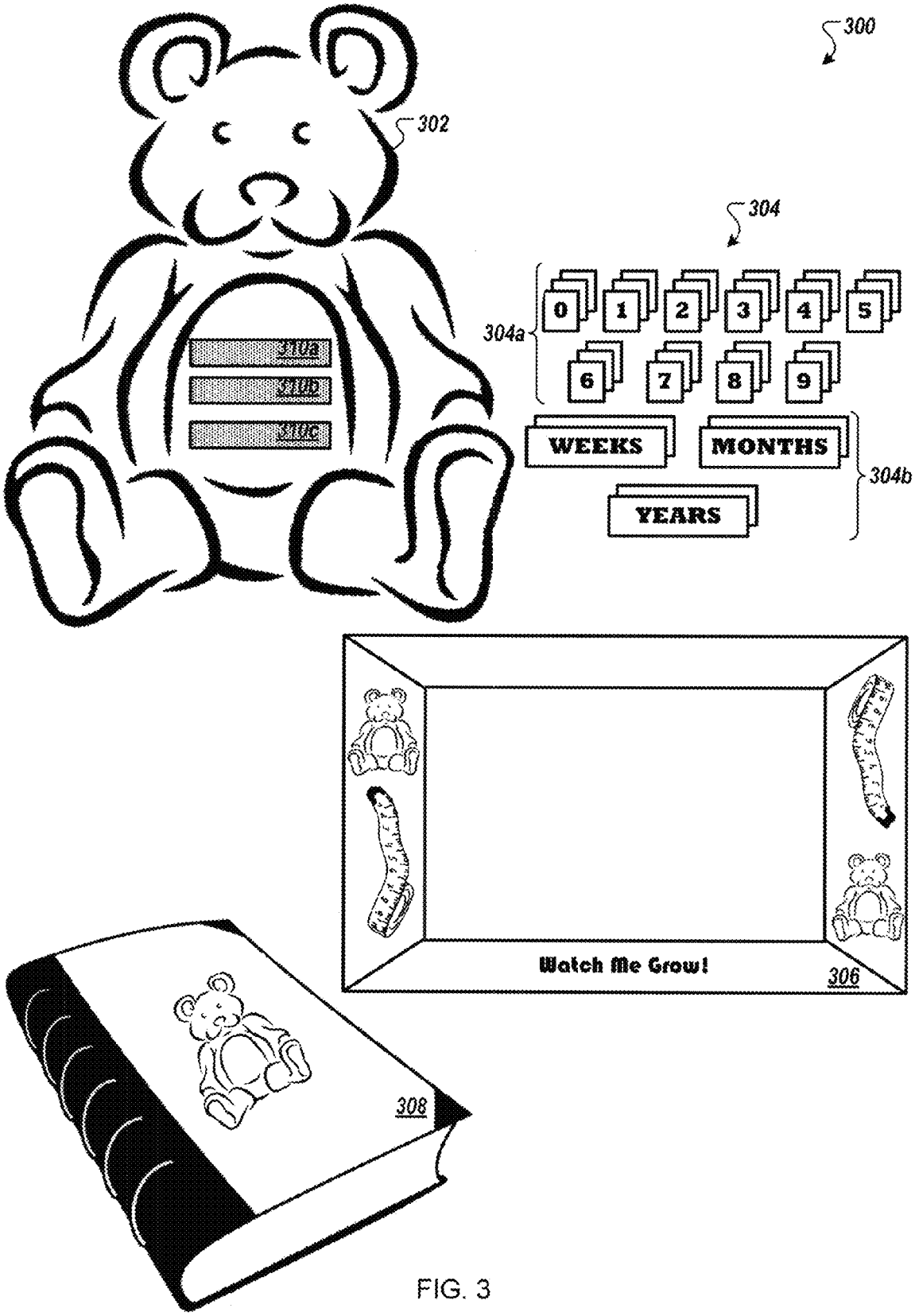
FIG. 3 illustrates an example system for documenting growth progression.

FIG. 3 illustrates an example system 300 for documenting growth progression. The system 300 includes a plush bear 302, a set of indicators 304, a photo frame 306, and a photo album 308. The photo frame 306 and the photo album 308 include decorations similar to the plush bear 302. The system 300, for example, could be marketed and sold as a set for the purposes of collecting and displaying a series of photographs of an object capable of growth, such as an infant. The infant, for example, could be placed near the plush bear 302 with one or more of the indicators 304, attached to the plush bear 302, indicating a current age of the infant.

The plush bear 302 includes a set of hook and loop fastener strips 310*a, b, c* for removably attaching the indicators 304 to the plush bear 302. The indicators 304, for example, can each include matching hook and fastener strips on the back. The indicators 304 can be arranged on the hook and loop fastener strips 310*a, b, c* to indicate an age, represented by one or more digit indicators 304*a* and, optionally, one or more time reference terms 304*b*, such as "WEEK", "WEEKS", "MONTH", "MONTHS", "YEAR", or "YEARS". For example, the message "1 YEAR 10 MONTHS 2 WEEKS" can be arranged on the plush bear 302 using the indicators 304.

A series of photographs, taken of an infant next to the plush bear 302, can be arranged in the photo album 308. Additionally, one of the photographs, such as the most recent photograph, can be displayed in the photo album 308.

While this description contains many specifics, these should not be construed as limitations on the scope of what is being claimed or of what may be claimed, but rather as descriptions of features specific to particular implementations. For example, although the system 300 is described in terms of documenting the growth progression of an infant next to a plush bear, other systems can include a decorative watering can with removably attachable indicators for documenting the growth of a plant or a fire hydrant figurine with removably attachable indicators for documenting the growth of a puppy. Certain features that are described in this description in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular implementations have been described. Other implementations are within the scope of the following claims.

What is claimed is:

1. A system for documenting the growth progression of an infant comprising:

a three-dimensional plush toy, unchangeable in size;

an element attached to a surface of the three-dimensional toy;

a first indicator releasably attachable to the element, the first indicator including a numerical digit and made from a first material;

a second indicator releasably attachable to the element, the second indicator including a numerical digit and made from a second material; and a third indicator releasably attachable to the three-dimensional plush toy, the third indicator including a set of alphabetical letters and made from a third material.

2. The system of claim 1, wherein the three-dimensional plush toy includes an item of apparel and the element is included on the item of apparel associated with the plush toy.

3. The system of claim 1, wherein the element includes one of a hook and loop fastener, a magnet, a zipper section, a snap section, a hook and eye portion, a button, a buttonhole, or a tie, and wherein the first and second indicators include respective connection points for removable attachment to the element.

4. The system of claim 1, wherein the element includes a set of rails.

5. The system of claim 1, wherein the element includes a set of pockets.

6. The system of claim 1, wherein the three-dimensional plush toy comprising a torso, a pair of arms, and a pair of legs, and the element is disposed on the torso of the plush toy.

7. The system of claim 1, wherein the first, second, and third material comprises one of a rigid or flexible material.

8. The system of claim 1, wherein one of the first, second, or third indicators comprises a digital display.

9. An apparatus for documenting the growth progression of an object capable of growth, the apparatus comprising:

a three-dimensional plush toy, unchangeable in size;

an element attached to a surface of the three-dimensional plush toy;

a first indicator releasably attachable to the element, the first indicator including a numerical digit and made from a first material;

a second indicator releasably attachable to the element, the second indicator including a numerical digit and made from a second material; and a third indicator releasably attachable to the three-dimensional plush toy, the third indicator including a set of alphabetical letters and made from a third material.

10. The apparatus of claim 9, wherein the element includes one of a hook and loop fastener, a magnet, a zipper section, a snap section, a hook and eye portion, a button, a buttonhole, or a tie, and wherein the first and second indicators include respective connection points for removable attachment to the element; and wherein the indicator includes respective connection points for removable attachment to the element.

11. The apparatus of claim 9, wherein the three-dimensional plush toy includes an item of apparel and the element is included on the item of apparel associated with the plush toy.

12. The apparatus of claim 9, wherein the element includes a set of rails.

13. The apparatus of claim 9, wherein the three-dimensional plush toy comprising a torso, a pair of arms, and a pair of legs, and the element is disposed on the torso of the plush toy.

14. The apparatus of claim 9, wherein the element includes a set of pockets.

15. The apparatus of claim 9, wherein the first, second, and third material comprises one of a rigid or flexible material.

16. The apparatus of claim 9, wherein one of the first, second, or third indicators comprises a digital display.

17. A method for documenting the growth progression of an object capable of growth, the method comprising:

providing a three-dimensional plush toy, unchangeable in size, the three-dimensional plush toy having an element attached to a surface of the three-dimensional plush toy;

providing a first indicator releasably attachable to the element, the first indicator including a numerical digit and made from a first material;

providing a second indicator releasably attachable to the element, the second indicator including a numerical digit and made from a second material; and providing a third indicator releasably attachable to the three-dimensional plush toy, the third indicator made including a set of alphabetical letters and made from a third material.

18. The method of claim 17, further comprising:

taking a photograph of the three-dimensional plush toy, the first, second, and third indicators at a first time; and taking a photograph of the three-dimensional plush toy, the first, second, and third indicators at a second time, wherein the first, second, and third indicators indicate a different date associated with the object or a different age of the object at the second time as compared to the first time.

19. The method of claim 17, wherein the three-dimensional plush toy comprises a torso, a pair of arms, and a pair of legs, and the element is disposed on the torso of the plush toy.

* * * * *

UNITED STATES PATENT AND TRADEMARK OFFICE

CERTIFICATE OF CORRECTION

PATENT NO. : 8,893,412 B2
APPLICATION NO. : 12/829124
DATED : November 25, 2014
INVENTOR(S) : Nathan S. Pendleton It is certified that error appears in the above-identified patent and that said Letters Patent is hereby corrected as shown below:

In claim 10, column 6, lines 11-13 (approx.), delete "wherein the first and second indicators include respective connection points for removable attachment to the element; and".

Signed and Sealed this
First Day of December, 2015

Michelle K. Lee

Michelle K. Lee
*Director of the United States Patent and Trademark Office*